United States Patent [19]

Rosebrock

[11] 4,046,980

[45] Sept. 6, 1977

[54] CAM ACTUATED SWITCH

[75] Inventor: Frederick Allen Rosebrock, Greenfield, Ind.

[73] Assignee: Bell Telephone Laboratories, Incorporated, Murray Hill, N.J.

[21] Appl. No.: 678,690

[22] Filed: Apr. 20, 1976

[51] Int. Cl.[2] ..... H01H 3/00

[52] U.S. Cl. ..... 200/153 LA; 179/164; 200/46; 200/38 B

[58] Field of Search ..... 179/164, 165; 200/38 R, 200/38 B, 46, 153 L, 153 LA, 153 LB

[56] References Cited

U.S. PATENT DOCUMENTS

| | | | |
|---|---|---|---|
| 3,027,432 | 3/1962 | Jordan et al. | 179/164 |
| 3,144,524 | 8/1964 | Hawley et al. | 200/46 |
| 3,562,464 | 2/1971 | Vollum et al. | 200/153 LA |
| 3,566,052 | 2/1971 | Mindell | 200/46 |
| 3,586,805 | 6/1971 | Ziegler, Jr. | 200/153 |
| 3,916,119 | 10/1975 | Gumb et al. | 179/164 |

*Primary Examiner*—Volodymyr Y. Mayewsky
*Attorney, Agent, or Firm*—Harry L. Newman

[57] ABSTRACT

The switch comprises a unitary dielectric support member including a base portion to which the fixed ends of a plurality of pairs of cantilever contact springs are secured. Guide portions of the support member define a channel, and a plurality of cam follower portions integrally hinged to the base portion respectively extend between the free ends of an associated contact spring of each pair and the channel. An actuator positioned within the channel includes cam portions for engaging the cam follower portions of the support member and deflecting them so as to displace the associated contact springs.

14 Claims, 7 Drawing Figures

800
820
830
810
650
614
600
614
500
514
418
415
414
450
454
400
414
418
450
314
300
452
416
218
254
215
214
250
200
252
214
252
114
111
152
130
100
138
110
154
130
138
150
714
750
700
752
900
970
950
950
970

CAM ACTUATED SWITCH

Field of the Invention

This invention relates to the field of electrical switches and within that field to cam actuated switches.

Background of the Invention

Essentially all telephones include a switch that is actuated by the removal of the telephone handset from and replacement of the handset on the telephone base. Basically, the actuation of the switch serves to connect the telephone to an associated telephone line responsive to the removal and to disconnect responsive to the replacement. This switch is therefore often referred to as the line switch. Nearly all line switches, however, perform functions in addition to the basic one. Consequently, they generally include between four and six contact pairs that are operated in a particular sequence.

The force necessary to operate the line switch is derived from the weight of the telephone handset, and over the years not only has the weight of the handset been reduced, but telephone base designs have been introduced wherein only a portion of the handset weight is applied to the line switch. Thus line switches have had to be designed that operate in response to smaller and smaller forces. More recently, this problem has been drastically compounded by the introduction of multiple line business sets that rely on the weight of the handset to both operate the line switch and operate a mechanism for releasing one or more latched down pushbuttons of a multiple pushbutton switch.

The magnitude of this problem is best understood by comparing existing line switches with the requirements imposed by this latest telephone set design. The line switch used in the general purpose telephone of the Bell System, which switch is of the type described on pages 266 and 267 of an article entitled, "An Improved Telephone Set" appearing in the April 1951 issue of the *Bell System Technical Journal,* has an operating force of 300 grams. The line switch used in the dialein-handset telephone of the Bell System, which switch is of the type disclosed in U.S. Pat. No. 3,027,432 issued to Messrs. H. G. Jordan, L. J. Purgett, W. E. Restall, Jr., and P. E. Schweizer on Mar. 27, 1962, has an operating force of 160 grams. The line switch for the new business telephone design must operate with a force of only 20 grams.

In addition, the line switch for this new design needs to be small in size, that is, no bigger than about a cubic inch in volume. It also needs to be comprised of relatively inexpensive components that are readily asembled so that the cost of the switch is kept low. Furthermore, to facilitate use of the switch in the wide variety of business sets being made available to telephone customers, the switch should permit the sequence in which the contact pairs are actuated to be readily changed. While it may seem that these combined requirements pose an impossible object to meet, a switch in accordance with the present invention can be designed to satisfy them all.

Summary of the Invention

A switch in accordance with the present invention comprises a number of coplanar cantilever movable contact springs that overlie a like number of coplanar cantilever stationary contact springs. The free ends of the movable contact springs extend beyond and are biased toward the free ends of the stationary contact springs. In addition, the fixed ends of the movable and stationary contact springs are insulated from one another by a dielectric spacer and are fastened to a base portion of a molded dielectric support member.

The support member includes a pair of spaced integral guide portions that extend from the base portion and define a channel for accommodating an actuator that is reciprocally displaceable beneath and generally parallel to the contact spring pairs. The support member also includes a plurality of cam follower portions that are equal in number to the contact spring pairs and are situated between the guide portions. The cam follower portions have a hammer-like configuration in that each comprises (1) a shank portion that is integrally hinged to the base portion and extends generally parallel to both the contact springs and the channel and (2) a head portion at the free end of the shank portion that extends transverse to the shank portion.

One end of each head portion extends into juxtaposition with the free end of an associated movable contact spring. The other end of each head portion extends into juxtaposition with the actuator, and cam surfaces on the actuator serve to sequentially deflect the cam follower portions responsive to displacement of the actuator. The cam follower portions in turn deflect the movable contact springs to effect corresponding sequential actuation of the contact pairs.

Because the movable contact springs are deflected sequentially and once deflected the force required to maintain them deflected is essentially zero, the force required to actuate the switch is low. Also, because the contact spring mounting surface, the cam followers, and the guide for the actuator are all integral elements of a unitary molded member and therefore do not need to be assembled, these elements and thereby the switch can be made quite small and the spatial relationship between these elements is accurately controlled. In addition, because these elements do not need to be assembled, and because the unitary support member, actuator, and contact springs are inexpensive to manufacture, and the contact springs do not need to be manually adjusted to provide the desired contact force, the cost of the switch is comparable to or less than any of the line switches presently in use by the Bell System. Finally, because the sequence in which the contact springs are actuated is determined by the actuator and because the actuator just slides into place, the same basic switch structure can be combined with any one of a number of different actuators to provide any desired sequence of contact actuation.

DETAILED DESCRIPTION

Figure 1:
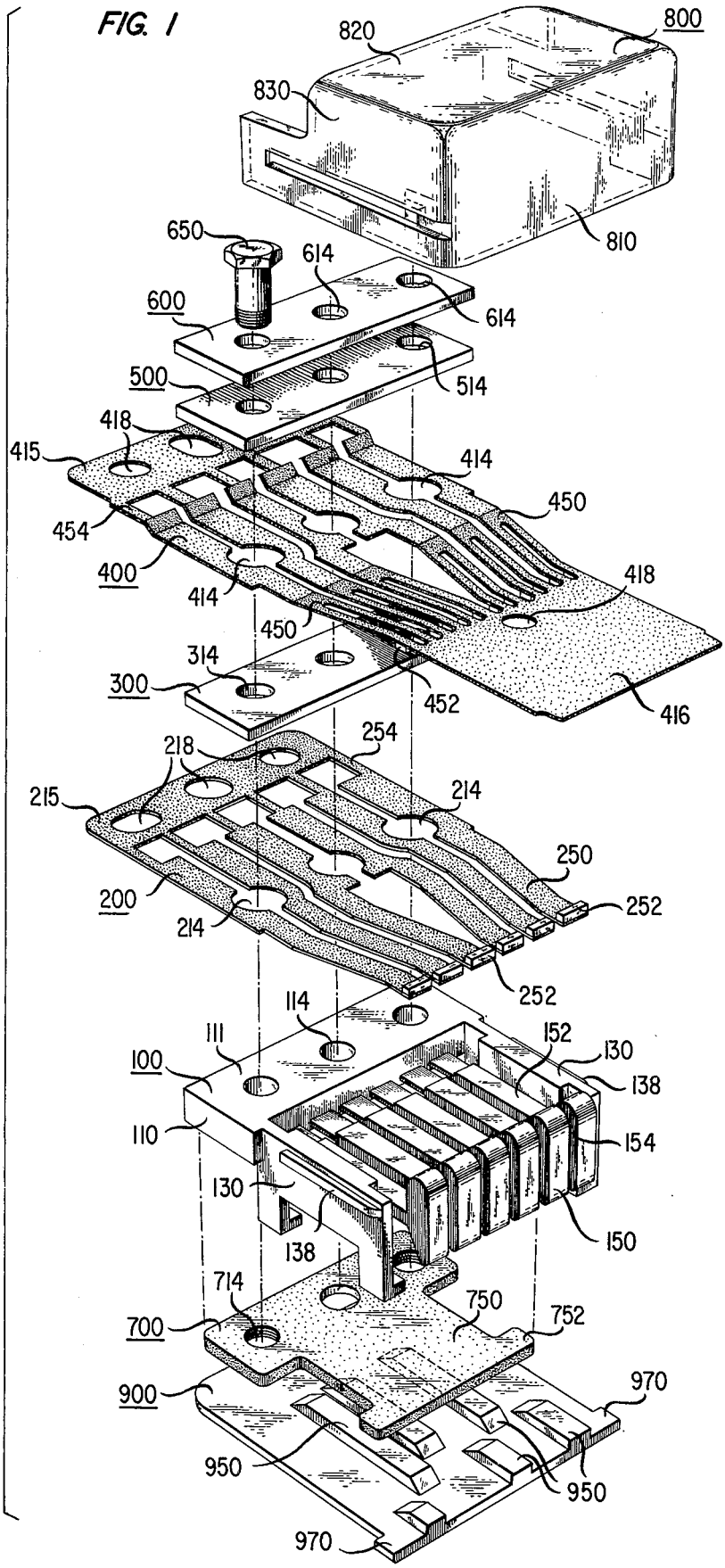
FIG. 1 is an exploded perspective view of a switch embodying the present invention.
Figure 2:
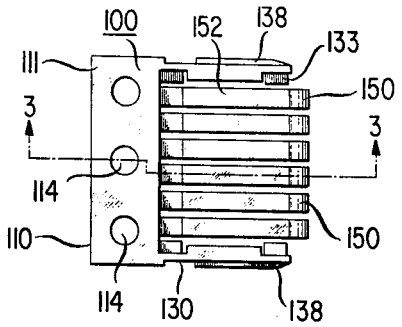
FIG. 2 is a top view of the unitary support member of the switch.

Referring to FIGS. 1 through 4 of the drawing, a switch in accordance with the present invention includes a unitary molded dielectric support member 100 comprising a base portion 110, a pair of guide portions 130, and a number of cam follower portions 150. The base portion 110 includes an upper mounting surface 111 and a recessed lower mounting surface 112 that lie in parallel planes. The base portion 110 also includes three spaced openings 114 that extend between the mounting surfaces 111 and 112.

Figure 3:
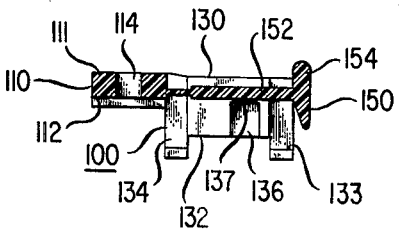
FIG. 3 is a sectional view of the support member taken along line 3—3 of FIG. 2.
Figure 4:
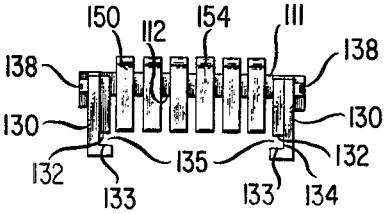
FIG. 4 is a front view of the support member.

The guide portions 130 extend from the base portion 110 and are spaced from and are essentially a mirror image of one another. As seen in FIGS. 3 and 4, the inside surface of each guide portion 130 includes spaced opposing surfaces 132 and 133 and joining surfaces 134 that combine with identical surfaces on the other guide portion to define a channel 135, best seen in FIG. 4, that extends beneath and generally parallel to mounting surfaces 111 and 112 of the base portion 110. The inside surfaces of each guide portion 130 also includes a recess 136, best seen in FIG. 3, the lower end of which is open and the upper end of which is closed to provide a stop 137 that lies in the plane of the lower mounting surface 112. Finally, the outside surface of each guide portion 130 includes a tongue 138 that extends generally parallel to the mounting surfaces 111 and 112 and the forward end of which is tapered.

The cam follower portions 150 are situated between the guide portions 130 and have a hammer-like configuration in that each comprises (1) a shank portion 152 that is integrally hinged to the base portion 110 and extends generally parallel to the mounting surfaces 111 and 112 thereof, and (2) a head portion 154 at the free end thereof that extends transverse to the shank portion. As most clearly seen in FIG. 3, the upper end of each head portion 154 extends above the plane of the upper mounting surface 111 and advantageously has a blunt shape. The lower end of each head portion 154 extends into close proximity with the channel 135 and advantageously has a tapered shape.

Referring now to FIG. 1, assembled to the upper mounting surface 111 of the base portion 110 is a contact spring pileup. The pileup comprises a stationary contact spring cluster 200, a dielectric spacer 300, a movable contact spring cluster 400, a dielectric spacer 500, and an upper clamping plate 600 respectively having mounting openings 214, 314, 414, 514, and 614 therein that are the same size as or larger than and are adapted to be placed in registration with the openings 114 in the base portion 110.

Figure 5:
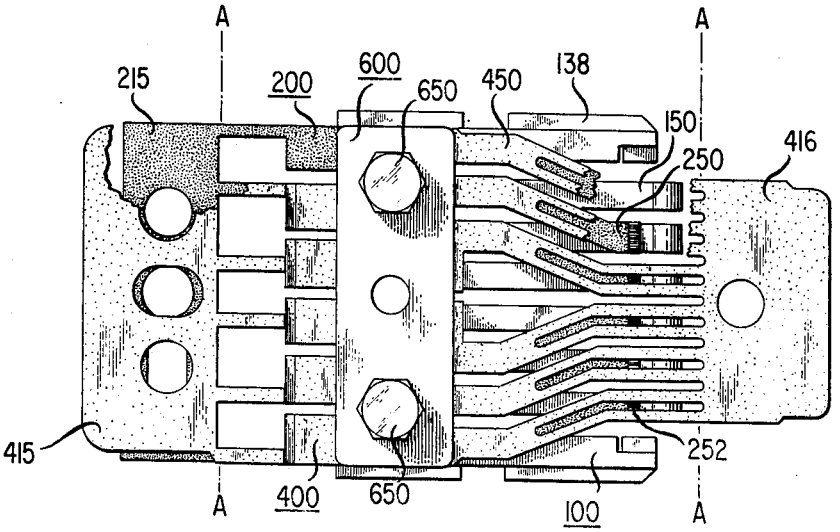
FIG. 5 is a top view partially in section showing the structure of the contact spring assembly of the switch at the time it is fastened to the support member.

The stationary and movable contact spring clusters 200 and 400 are advantageously formed from sheet stock of a gauge such that the stationary contact spring cluster is relatively stiff while the movable contact spring cluster is relatively flexible. In addition, the stationary and movable contact spring clusters 200 and 400 are advantageously respectively formed with webs 215 and 415 at the rear thereof, the movable contact spring cluster also having a web 416 at the front thereof. This permits each contact spring cluster to be assembled to the support 100 as a unit. Furthermore, the webs 215, 415, and 416 are advantageously respectively provided with one or more fixture holes 218 and 418 which in combination with an appropriate fixture assure the proper orientation of the contact spring clusters with respect to one another and the support 100. Thus it is seen that the webs 215, 415, and 416 greatly facilitate and reduce the cost of the assembly operation, and after assembly to the support 100 is completed, the webs are readily trimmed off along the lines A—A shown in FIG. 5.

When the trimming operation is completed, it is seen that the stationary contact spring cluster 200 comprises a plurality of coplanar contact springs 250 equal in number to the cam follower portions 150 of the support 100. Each stationary contact spring 250 has an upward facing contact 252 at the forward end thereof and a terminal post 254 at the rear end thereof. In somewhat similar fashion, the movable contact spring cluster 400 comprises the same number of coplanar contact springs 450, but the forward portion of each contact spring is bifurcated, the bifurcations having downward facing contacts 452. The forward portions of both the stationary and movable contact springs 250 and 450 are shaped so that the forward ends have the same spacing as the cam follower portions 150, and the contacts 452 are located so as to be in registration with the contacts 252.

The movable contact springs 400 are longer than the stationary contact springs 250 and therefore the forward ends of the movable contact springs extend for a distance beyond the contacts 452 thereof. Furthermore, the forward portion of the movable contact springs 450 are provided with a permanent set so that the forward portions incline toward the stationary contact springs 250. This permanent set provides a predetermined contact force once the contacts are assembled. Finally, the rear ends of the movable contact springs 450 are provided with a bend to increase the spacing of terminal posts 454 thereat from the terminal posts 254 of the stationary contact spring 250.

The stationary contact spring cluster 200, spacer 300, movable contact spring cluster 400, spacer 500, and upper clamping plate 600 are secured to the support 100 by a pair of fasteners 650 only one of which is shown. The heads of the fasteners 650 engage the upper clamping plate 600 while the stems of the fasteners extend through the two outside holes 614, 514, 414, 314, 214, and 114 of the associated components and thread into correspondingly spaced tapped holes 714 in the lower clamping plate 700, the plate being positioned in engagement with the lower mounting surface 112 of the base portion 110. The fasteners 650 draw the upper and lower clamping plates 600 and 700 toward one another and thereby clamp the stationary and movable contact spring clusters 200 and 400 in place. The center holes in these components are used to accommodate a fastener that secures the switch to an appropriate mounting bracket.

Figure 6:
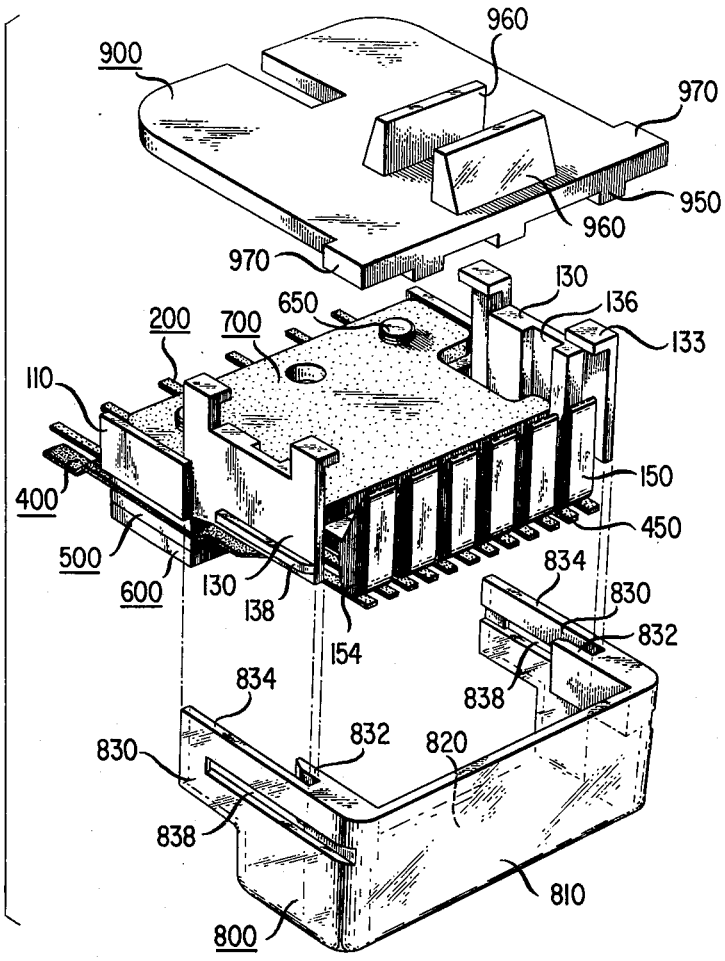
FIG. 6 is an exploded perspective view showing the switch inverted and all components, other than the actuator and cover, assembled.

The lower clamping plate 700 includes a forward extending portion 750 including laterally extending tabs 752, and as seen most clearly in FIG. 6, the tabs are accommodated within the recesses 136 of the guide portions 130 of the support 100. The tabs 752 engage the stops 137 (FIG. 3) provided by the closed ends of the recesses 136, and as viewed in FIG. 6, serve to prevent any counterclockwise deflection of the guide portions 130 with respect to the base portion 110.

Further rigidity for the guide portions 130 is provided by a transparent protective cover 800 that is snap mounted on the support 100. The cover 800 comprises a front portion 810, a top portion 820, and a pair of side portions 830. The side portions 830 include short inner walls 832 and long outer walls 834, and as indicated in FIG. 6, these walls are adapted to embrace the forward ends of the guide portions 130 and thereby prevent any lateral deflection of the guide portions when the cover 800 is in place.

The cover 800 is secured in place by means of grooves 838 in the outer walls 834 that are adapted to accommodate the tongues 138 of the guide portions 130. The spacing of the outer walls 834 is such that as the cover 800 is moved rearwardly with the grooves 838 in the plane of the tongues 138, the outer walls are spread apart by the tongues. Continued rearward movement of the cover 800 moves the grooves 838 into registration with the tongues 138 at which time the outer walls 834 return to their normal spacing and capture the tongues within the grooves. The cover 800 is advantageously mounted on the support 100 immediately after the webs 215, 415, and 615 are respectively severed from the stationary and movable contact spring clusters 200 and 400. The contact springs are then protected by the front and top portions 810 and 820 of the cover 800 from any damage that might occur during subsequent handling of the switch.

Figure 7:
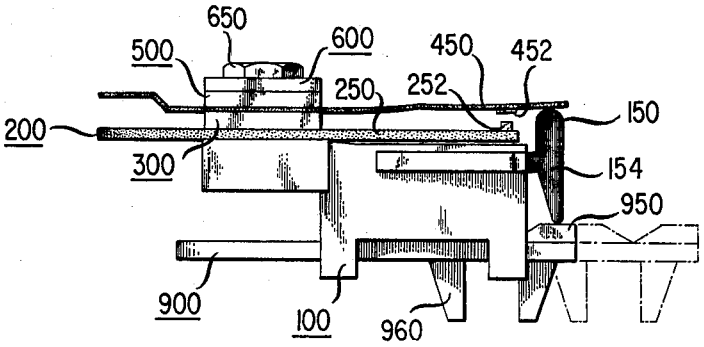
FIG. 7 is a side view of the assembled switch without the cover.

Referring now to FIGS. 6 and 7, it is seen that with the contact spring pileup assembled to the support 100, the free ends of the movable contact springs 450 extend into juxtaposition with the blunt ends of the head portions 154 of the cam follower portions 150. Furthermore, the dimensions of the spacer 300, the contacts 252 and 452 of the stationary and movable contact springs 250 and 450 respectively, and the cam follower portions 150 are such that when the contacts are closed, the free ends of the movable contact springs are immediately adjacent to the blunt ends of the head portions 154 and the tapered ends of the head portions are immediately adjacent to the channel 135. As a result of these relationships, an actuator 900 of a size to be slidably displaceable within the channel 135, provides the means for operating the contact spring pairs.

Referring now also to FIG. 1, the actuator 900 includes a plurality of cam portions 950, each of which is adapted to engage a tapered end of the head portion 154 of an individual cam follower portion 150 during a portion of the travel of the actuator. Each cam portion 950 protrudes above the channel 135 a distance such that when it engages its associated head portion 154, the head portion and thereby the movable contact spring 450 in engagement with the head portion is deflected to separate the contacts 452 on the movable contact spring from the contact 252 on the associated stationary contact spring 250. When, on the other hand, one of the head portions 154 moves off of an associated cam portion 950, the contacts 452 on the movable contact spring 450 associated with the head portion move into engagement with the contact 252 on the associated stationary contact spring 250.

With the cam portions 950 staggered such as shown in FIG. 1, the movable contact springs 450 are operated sequentially and only a very low force is required to displace the actuator 900. This force is reduced even further by choosing the materials from which the support 100 and the actuator 900 are formed to have the lowest possible coefficient of friction with respect to one another. Since the actuator 900 is a relatively inexpensive component to mold, the sequence of contact operation can be altered by merely replacing one actuator with another of the appropriate configuration. Leg portions 960 extending from the side opposite to the cam portions 950 provide the means for displacing the actuator 900, the laterally extending tab portions 970 at one end of the actuator provide a known starting point for the displacement.

Although but one embodiment of the invention has been shown and described, it will be understood that it is but illustrative and that various modifications may be made herein without departing from the scope and spirit of this invention as defined in the appended claims.

What is claimed is:

1. A switch comprising:

a pair of cantilever contact springs, the fixed ends of the contact springs being electrically insulated from one another and the free end portions of the contact springs extending into juxtaposition with one another and having contact surfaces for engaging one another;

a unitary support member including:

1. integral base means to which the fixed ends of the contact springs are secured,
2. integral guide means defining a channel, and
3. integrally hinged cam follower means extending between the free end portion of a first of the contact springs and the channel, the support member being electrically insulated from the contact springs; and an actuator positioned within the displaceable along the channel, the actuator including cam portions for engaging the cam follower means and deflecting them so as to displace the first contact spring to effect operation of the switch.

2. A switch as in claim 1 wherein the first contact spring overlies and is biased toward the second of the contact springs and the free end of the first contact spring extends beyond the free end of the second contact spring, the cam follower means extending into juxtaposition with the free end of the first contact spring.

3. A switch as in claim 1 wherein the cam follower means has a hammer-like configuration in that it comprises a shank portion integrally hinged at one end and a head portion at the other end of the shank portion.

4. A switch as in claim 3 wherein the contact springs extend generally parallel to one another, the shank portion extends generally parallel to the contact springs, and the head portion extends transverse to the shank portion, one end of the head portion extending into juxtaposition with the first contact spring and the other end of the head portion extending into juxtaposition with the channel.

5. A switch comprising:

a plurality of pairs of cantilever contact springs, the fixed ends of the contact springs of each pair being electrically insulated from one another and the free end portion of the contact springs of each pair extending into juxtaposition with one another and having contact surfaces for engaging one another;

a unitary support member including:

1. a base portion to which the fixed ends of the contact springs are secured,
2. guide portions integral to the base portion defining a channel, and
3. a plurality of integrally hinged cam follower portions extending between the free end portion of a first of the contact springs of each pair and the channel, the support member being electrically insulated from the contact springs; and an actuator positioned within and displaceable along the channel, the actuator including cam portions for engaging the cam follower portion and deflecting them so as to displace the first contact spring to effect operation of the switch.

6. A switch as in claim 5 wherein the contact spring pairs comprise a plurality of spaced coplanar cantilever movable contact springs respectively overlying a plurality of spaced coplanar cantilever stationary contact springs, the free ends of the movable contact springs being biased toward and extending beyond the free ends of the stationary contact springs and the cam follower portions respectively extending into juxtaposition with the free ends of the movable contact springs.

7. A switch as in claim 6 wherein the cam follower portions have a hammer-like configuration in that each comprises a shank portion integrally hinged to the base portion and a head portion at the free end of the shank portion.

8. A switch as in claim 7 wherein the shank portions of the cam follower portions extend generally parallel to the contact springs and the head portions extend transverse to the shank portions.

9. A switch as in claim 8 wherein the guide portions straddle the cam follower portions and the facing surfaces of each guide portion include spaced opposing surfaces and a joining surface extending transverse to the opposing surfaces, these surfaces in combination with like surfaces on the other guide portion serving to define the channel.

10. A switch as in claim 9 wherein the channel extends generally parallel to the contact spring pairs.

11. A switch as in claim 5 wherein the base portion includes an upper mounting surface on which the contact spring pairs are positioned and a lower mounting surface on which a lower mounting plate is positioned, fasteners for securing the contact spring pairs to the support member being threaded into the lower mounting plate.

12. A switch as in claim 11 wherein the lower mounting plate includes a portion that extends between the guide portions and provides support therefor.

13. A switch as in claim 5 further including a cover mounted on the guide portions; the cover extending between the guide portions in juxtaposition with the free end portions of the contact spring pairs, and the cover including side portions that embrace the guide portions and provide support therefor.

14. The switch as in claim 5 wherein the actuator includes integral means extending from the side opposite to the cam portions for displacing the actuator and means at one end thereof for providing a reference point for that displacement.

* * * * *

UNITED STATES PATENT AND TRADEMARK OFFICE

CERTIFICATE OF CORRECTION

PATENT NO. : 4,046,980

DATED : September 6, 1977

INVENTOR(S) : Frederick A. Rosebrock

It is certified that error appears in the above-identified patent and that said Letters Patent are hereby corrected as shown below:

Column 1, line 41, "dialein-handset" should read --dial-in-handset--. Column 6, line 2, "the" should read --that--; line 26, "the" should read --and--.

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*